US005108100A

United States Patent [19]

Essebaggers et al.

[11] Patent Number: 5,108,100

[45] Date of Patent: Apr. 28, 1992

[54] PYRAMID PUZZLE FORMED FROM TETRAHEDRAL AND OCTAEDER PIECES CONNECTED BY A STRAND

[76] Inventors: Jan Essebaggers, Burg. Vogelaarsingel 11, 2912 BB Nieuwerkerk a/d IJssel; Jaap Koops, Penningkruid 7, 2914 BW Nieuwerkerk a/d IJssel, both of Netherlands

[21] Appl. No.: 540,113

[22] Filed: Jun. 19, 1990

[30] Foreign Application Priority Data

Nov. 13, 1989 [NL] Netherlands ..... 8902693

[51] Int. Cl.[5] ..... A63F 9/08

[52] U.S. Cl. ..... 273/153 R; 273/157 R; 273/159; 446/487

[58] Field of Search ..... 273/153 R, 153 P, 155, 273/156, 157 R, 159, 160; 446/92, 487, 901, 490

[56] References Cited

U.S. PATENT DOCUMENTS

| | | | |
|---|---|---|---|
| 994,227 | 6/1911 | Whitelaw | 273/157 R |
| 2,041,030 | 5/1936 | Strutton | 273/157 R |
| 2,216,915 | 10/1940 | Johnson | 273/157 R |
| 2,429,027 | 10/1947 | Myers | 273/157 R |
| 2,617,654 | 11/1952 | Nolan et al. | 273/156 |
| 2,839,841 | 6/1958 | Berry | 273/157 R |
| 3,222,072 | 12/1965 | Dreyer | 273/153 R |
| 3,565,442 | 2/1971 | Klein | 273/157 R |
| 3,645,535 | 2/1972 | Randolph | 273/157 R |
| 4,133,538 | 1/1979 | Ambrose | 273/157 R X |
| 4,258,479 | 3/1981 | Roane | 273/157 R |
| 4,790,759 | 12/1988 | Mosseri et al. | 273/157 R X |

FOREIGN PATENT DOCUMENTS

| | | | |
|---|---|---|---|
| 1417901 | 8/1988 | U.S.S.R. | 273/155 |

*Primary Examiner*—Edward M. Coven
*Assistant Examiner*—William M. Pierce
*Attorney, Agent, or Firm*—Hoffmann & Baron

[57] ABSTRACT

The invention provides a puzzle embodied in a 3-sided regularly shaped pyramid comprising eleven smaller 3-sided pyramids and four small octaeder shaped bodies, which smaller pieces are connected to a string forming an endless chain. The complexity of the puzzle is achieved by coloring the side planes of the smaller parts in various colors and connecting the smaller pieces in a certain sequence to a string. The solution of the puzzle is obtained by placing the smaller parts of puzzle in such a way that the large pyramid is formed and the side planes of the large pyramid are uniformly colored by the smaller pieces. A preferred embodiment is given in FIGS. 1 and 2 comprising the 15 smaller pieces of FIGS. 3 and 4 placed in a continuous string as shown in FIG. 5.

10 Claims, 1 Drawing Sheet

L=3l

Fig. 4-a

PYRAMID PUZZLE FORMED FROM TETRAHEDRAL AND OCTAEDER PIECES CONNECTED BY A STRAND

SUMMARY OF THE INVENTION

The invention relates to a puzzle in the form of a 3-sided regularly shaped pyramid, comprising eleven smaller 3-sided pyramides similar in shape as the large pyramid (regular 4-plane) and four octaeder shaped bodies (regular 8-plane). The length of each side of the smaller pyramides and of the octaeder shaped bodies is equal to $\frac{1}{3}$ of the length of the sides of the large pyramid (L=31).

The eleven smaller pyramids together with the four octaeder shaped bodies fit exactly within the embodiment of the large pyramid.

Each side plane of the smaller pyramids and octaeders is colored in such a way that there is at least one solution of the puzzle whereby the side planes of the large pyramid are uniformly colored. The complexity of the puzzle can be altered by the way the side planes of the smaller pyramids and octaeder are colored.

The complexity of the puzzle can be further increased by putting all eleven small pyramides and four octaeders to a string in such a way that they form so to speak an endless chain.

An additional advantage of the string is that all pieces of the puzzle remain together and will not get lost, leaving the puzzle incomplete.

In order to enable the smaller pieces of the puzzle to stick together in forming the large pyramid, magnetic material could be used in the side planes of the smaller pieces, however, is not restricted to this solution. Other solutions are possible such as adhesive material or a male/female connection as shown in the accompanying figure (FIG. 6).

DETAILED DESCRIPTION OF THE PREFERRED EMBODIMENT

Figure 1:
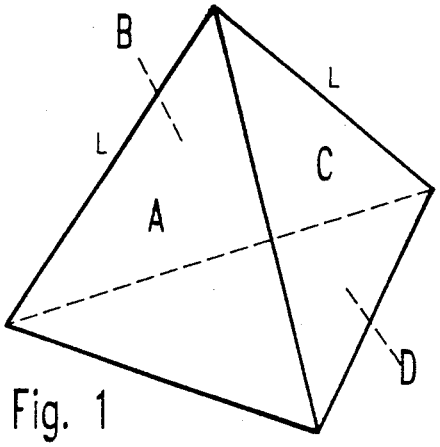
FIG. 1 shows the shape of the completed puzzle.

Various embodiments of the pyramid-puzzle are conceivable in size, colors, overprints etc. The invention will now be further explained with reference to a preferred embodiment given in the drawings.

In FIG. 1 shows the completed 3-sided regularly shaped pyramid puzzle in perspective with four uniformly but different colored planes A, B, C, and D.

Figure 2:
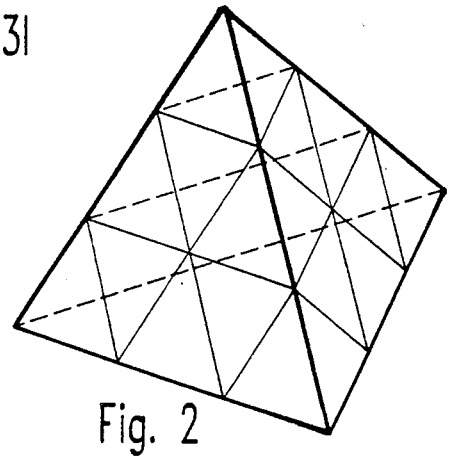
FIG. 2 shows the composition of the completed puzzle.
Figure 3:
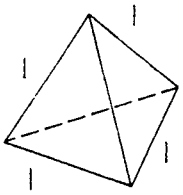
FIG. 3 shows the 3-sided pyramid shaped bodies.
Figure 4:
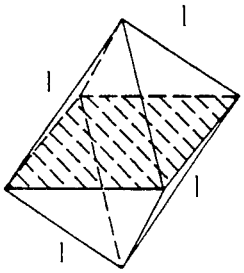
FIG. 4 shows the octaeder shaped bodies.

In FIG. 2 the composition of the pyramid is shown comprising the eleven small 3-sided pyramids and four small octaeder shaped bodies, of FIGS. 3 and 4 respectively.

In FIG. 3 one of the eleven small 3-sided regularly shaped pyramids is drawn (regular four-plane).

In FIG. 4 one of the four small regular octaeder shaped bodies is drawn (regular eight-plane). Each octaeder shaped body can be further divided in two 4-sided regularly shaped pyramids, with a square base plane as drawn in FIG. 4*a*.

The length of all sides of both the small pyramids of FIG. 3 as well as the length of the sides of the octaeders of FIG. 4 and 4-sided pyramides of the FIG. 4*a*. is equal to $\frac{1}{3}$ of the length of each side of the large pyramid. All side planes of the small pyramids of FIG. 3 and octaeders of FIG. 4 are colored differently, in such a way that when combined to the large pyramid there will be at least one solution to uniformly color the side planes of the large pyramid of FIG. 1 and 2.

Figure 5:
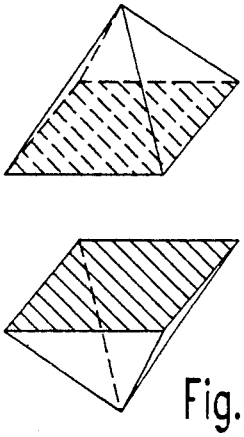
FIG. 5 show the unassembled bodies connected together on a string.
Figure 5:
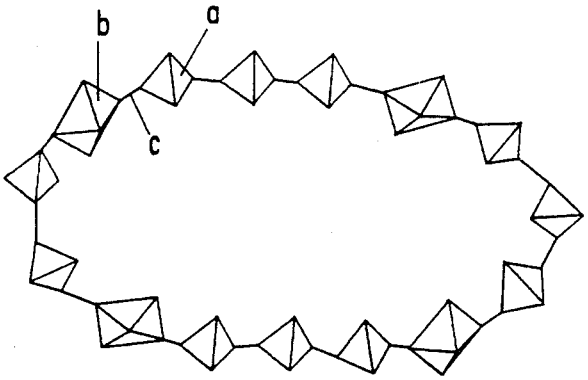

In FIG. 5 the eleven small pyramids (a) and four octaeders (b) are connected via a string (c) to form a circle in the shape of an endless chain. The coloring of the side planes of the small pieces the puzzle (a) and (b), and the sequence these pieces are placed in the string (c) is such that when the puzzle is put together they form the large pyramid, while there will be always one solution to the puzzle, assuring that the four sides of the large pyramids are uniformly colored.

Using a string makes the puzzle more complex, while in addition this string keeps the small pieces together, assuring that the puzzle always remains complete. In order to keep the pieces together, however, other solutions are possible, like a small joint at the corners of the individual pieces.

Figure 6:
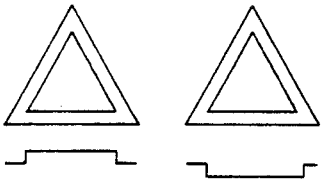
FIG. 6 shows male-female connections between the pieces.

In order to allow that the puzzle remains together as a solid pyramid, the side planes of the smaller pieces are joined together by a so called male-female connection in accordance with a solution as shown in FIG. 6. This connection, however, can also be replaced by magnetic means of adhesive material.

Also other embodiments of this puzzle are possible such as regular shaped 4-sided pyramids or enlarged 3-sided pyramides with more pieces than shown in the described of this puzzle.

What is claimed is:

1. A 3-dimensional, geometric puzzle comprising:

eleven tetrahedral pieces, each identical to one another in shape and dimension and each having a shape and a plurality of edges conforming to a regular tetrahedron having surface planes, each of said plurality of edges being of a first length;

four octaeder pieces, each identical to one another in shape and dimension and each having a shape and a plurality of edges conforming to a regular octagon having surface planes, each of said plurality of edges being of said first length; and, means for connecting said tetrahedral pieces and said octaeder pieces in a specified sequence in a strand, said pieces are distanced from one another in said strand to permit orienting of said pieces relative to one another to form a 15-member structure having, in its assembled state, a plurality of edges and a shape conforming to a regular tetrahedron having surfaces, each of said plurality of edges of said 15-member structure being of a second length, said second length being substantially equal to three times the length of said first length.

2. The 3-dimensional, geometric puzzle of claim 1, wherein said strand is a continuous loop.

3. The 3-dimensional, geometric puzzle of claim 1, wherein the surfaces of said pieces have colored indicia whereby said 15-member structure is colored with a color uniformly appearing on each surface of said structure.

4. The 3-dimensional, geometric puzzle of claim 1, wherein said means for connecting said tetrahedral pieces and said octaeder pieces in said specified sequence in said strand is a string.

5. The 3-dimensional, geometric puzzle of claim 1, wherein said sequence comprises a first tetrahedral piece followed by a first octaeder piece followed by a second tetrahedral piece followed by a third tetrahedral piece followed by a fourth tetrahedral piece followed by a second octaeder piece followed by a fifth tetrahedral piece followed by a sixth tetrahedral piece followed by a seventh tetrahedral piece followed by a third octaeder piece followed by an eighth tetrahedral piece followed by a ninth tetrahedral piece followed by a tenth tetrahedral piece followed by a fourth octaeder piece followed by an eleventh tetrahedral piece.

6. The 3-dimensional, geometric puzzle of claim 5, wherein said first tetrahedral piece is connected to said eleventh tetrahedral piece so as to make said strand continuous.

7. The 3-dimensional, geometric puzzle of claim 1, wherein said tetrahedral pieces and said octaeder pieces are formed with means for securing said surface planes of said pieces to one another in order to form said 15-member structure.

8. The 3-dimensional, geometric puzzle of claim 7, wherein said means for securing said pieces is a magnetic means.

9. The 3-dimensional, geometric puzzle of claim 7, wherein said means for securing said pieces is an adhesive material.

10. The 3-dimensional, geometric puzzle of claim 7, wherein said means for securing said pieces are cooperating mechanical parts.

* * * * *